United States Patent [19]

van der Horst

[11] Patent Number: 4,461,500

[45] Date of Patent: Jul. 24, 1984

[54] SWINGING LATCH BOLT FOR SLIDING WINDOWS

[75] Inventor: Jasper van der Horst, Veenendaal, Netherlands

[73] Assignee: Stenman Holland B.V., Veenendaal, Netherlands

[21] Appl. No.: 269,766

[22] Filed: Jun. 3, 1981

[51] Int. Cl.³ ..... E05C 19/12

[52] U.S. Cl. ..... 292/128; 292/106; 292/DIG. 46

[58] Field of Search ..... 292/128, 228, 106, 207, 292/101, 103, 202, DIG. 46

[56] References Cited

U.S. PATENT DOCUMENTS

| | | | |
|---|---|---|---|
| 445,108 | 1/1891 | Wright | 292/207 X |
| 632,215 | 8/1899 | Davidson | 292/106 X |
| 3,078,524 | 2/1963 | Minick | 292/228 X |
| 3,161,923 | 12/1964 | Crain | 292/128 |
| 3,220,759 | 11/1965 | Miller | 292/228 X |
| 3,349,532 | 10/1967 | Dodoff | 52/238.1 X |
| 3,600,019 | 8/1971 | Toyota | 292/106 |
| 3,808,742 | 5/1974 | Ehret et al. | 49/449 X |
| 3,893,261 | 7/1975 | Cribben | 292/128 X |
| 4,042,004 | 8/1977 | Kwan | 49/449 X |
| 4,202,136 | 5/1980 | Riegelman | 49/449 |

FOREIGN PATENT DOCUMENTS

| | | | |
|---|---|---|---|
| 502702 | 3/1939 | United Kingdom | 292/228 |

*Primary Examiner*—Gary L. Smith
*Assistant Examiner*—R. Illich
*Attorney, Agent, or Firm*—Silverman, Cass & Singer, Ltd.

[57] ABSTRACT

A latch bolt for locking sliding windows. The bolt includes a housing and a spring biased handle formed with a pivotal stump. The pivotal stump is seated within the housing, the handle being locked against any axial displacement. The housing is provided with a channel in which at least one insert is disposed for locking the handle against axial displacement. A spring is disposed interior of the channel and between the assembled pivot stump and housing.

10 Claims, 3 Drawing Figures

SWINGING LATCH BOLT FOR SLIDING WINDOWS

BACKGROUND OF THE INVENTION

1. Field of the Invention

The present invention relates to a bolt, comprising a housing, and a wedge-shaped handle provided with a sloping surface, the backside of which comprises a recess serving as a hook, said handle being displaceable with respect to the housing, against the action of springs.

The present invention relates to a latch bolt comprising a housing and a wedge-shaped handle provided with a sloping surface having an undersurface defining a recess serving as a hook, said handle including a pivot stump within a channel formed in the housing and being displaceable relative the housing and against the action of springs seated interior of the channel when the pivot stump is assembled therein.

Handles of the general type with which this invention is concerned are employed for locking or latch bolts for sliding windows, say of boats, caravans, edifices (buildings) and the like. These bolts generally include a handle positioned near the leading edge of those elements which are arranged sliding one relative to the other. These handles are provided with a portion having a sloping surface. The portion to be locked is provided with a glazing strip or ledge which is capable of sliding movement along the sloping surface causing the handle to yield and snap behind the strip, the handle portion being provided with a recess-defining section which functions as a hook. Known handles are spring biased and usually employ plate spring means which normally are deformed with age causing the handle to operate less than optimally. Additionally, prior available handles of this general type are quite cumbersome to install, the mounting thereof being difficult.

SUMMARY OF THE INVENTION

A latch bolt assembly particularly suitable for use with sliding windows employed on boats, caravans and also for sliding windows of edifices (buildings).

The invention specifically relates to a latch bolt which is capable of being mounted against a frame or a post. The locking bolt may, for building purposes, consist of an extruded durable material, such as anodized aluminum, so that not only a deformation of the entity is prevented, but also an esthetically attractive result is obtained.

The invention provides a latch bolt including a handle having a neck formation terminating in a pivotal stump portion received within a U-shaped channel formed in a housing. The channel is defined by a mounting base and generally parallel legs including at least one leg having an elongate flange directed toward the other leg so as to narrow the mouth of the channel, said legs enclosing the pivotal stump portion when same is seated within the channel. The handle with the pivotal stump portion thereof is locked within the channel and is prevented from being axially displaced by introduction of at least one nonrotatable insert element fixedly seated within said channel. In one embodiment of the invention, the pivotal stump is provided with a portion which is staggered with respect to the channel wall of the housing. The nonrotatable insert element is seated within the channel and is longitudinally slidable with respect thereto, at least one part of the insert being received between the wall of the channel and the staggered portion of the pivotal stump through a slot formed in one leg.

Thus the handle may be locked when the insert starts to slide so that the handle cannot be dislodged and displaced from its locked condition as for example by children.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF A PREFERRED EMBODIMENT

Figure 1:
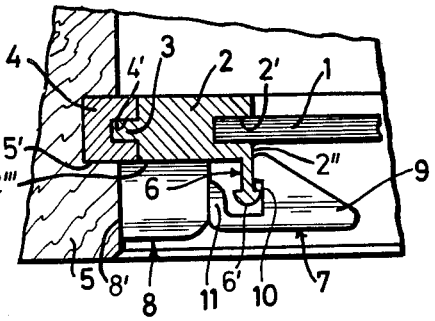
FIG. 1 is a horizontal cross section of the end of a sliding window to be opened.

Therefore, there is illustrated one embodiment of a sliding window suitable for use with the latch bolt of the invention. The sliding window 1 is provided with a glazing strip member 2. The strip member 2 is provided with longitudinal flange 3 which functions as a rail. Flange or rail 3 is seated in groove 4' of elongate member 4. Additionally, strip member 2 is provided with a groove or glazing seat 2' capable of accommodating the window 1.

The frame 5 is provided with a groove 5' of cross-sectional configuration conforming to the cross-sectional configuration of track 4 and which seats track 4 tightly therein. Strip member 2 is provided with outwardly extending flange 6 extending along the edge 2'' of strip 2, flush with said edge 2'' and directed outward normal to the surface 2''' of strip 2. Flange 6 includes an enlarged head portion 6' extending longitudinally along said flange 6.

The window 1, along with strip 2 and flange 6, is shiftable manually. The base 8' of housing 8 of the invention is secured, as by suitable screw means, (not shown), against the frame 5, the bolt 7 comprising an assembly of the handle 7 and housing 8.

The handle 7 is formed as a profiled extrusion defining a base 7', a pair of spaced apart pivotal stumps 12, 12', a neck 11 and a hook-shaped portion 10 with a recess 10' defined therebetween. The handle 7 also is formed with a sloping outer surface 9.

The housing 8 is also of an elongate generally U-shaped cross-sectional configuration having base portion 8' and opposite legs 13 and 15 with outer surfaces 13' and 15' being parallel and normal to the base portion 8 and inner surfaces 13'' and 15'' defining an elongate channel 34 having entrance 36. The entrance 36 is narrowed by inwardly curved edge portion 14 of leg 13 formed unitary therewith at its free end. The handle 7 is received yieldably within channel 34 of housing 8 with the pivotal stump 12 engaged within said channel 34. Upon the closing of the window, flange 6 of strip 2 abuts against the sloping surface 9 of said handle, so that the latter yields and surface 9 with hook-shaped part 10 will snap behind the flange 6 of strip 2. When the window has to be opened, handle 7 is drawn toward the rear thus enabling the release of flange 6 from recess 10, so that said window can be slid open.

Handle 7 merges into a neck 11 and the pivotal stump 12 fits into a channel 34 of housing 8. At least one leg 13 of said housing has an arcuate flange 14 directed toward the other leg 15. Thus, the pivotal stump 12 of handle 7 is enclosed near neck 11, and handle 7, with its pivotal stump 12, is locked in housing 8 against axial displacement by at least one insert 16 which is seated fixedly in the channel 34. Insert 16 is shown as end caps inserted in the open ends of channel 34 of housing 8.

Figure 2:
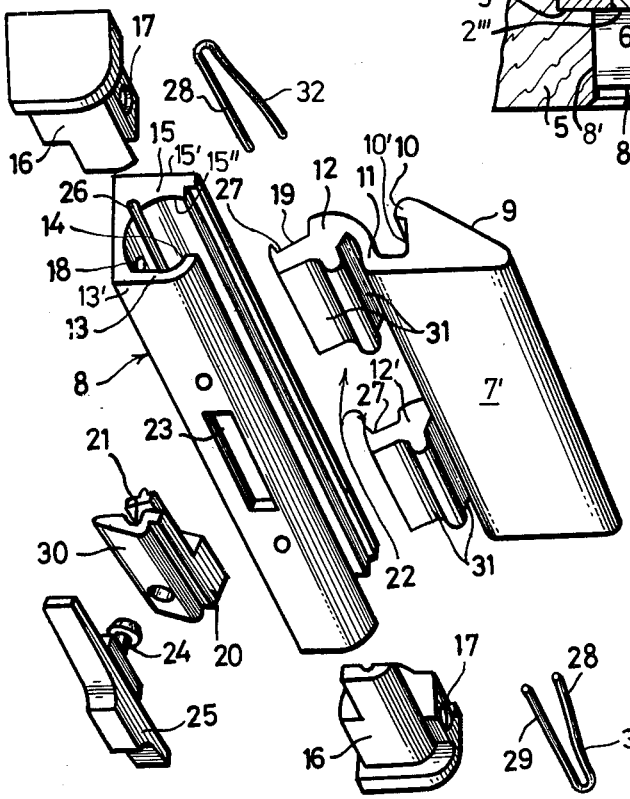
FIG. 2 is an exploded perspective view of a bolt in accordance with the invention the spring being shown in exaggerated length.

Referring now to FIG. 2, handle 7 with its pivotal stump 12 is illustrated in position for insertion in housing 8 between two inserts 16 secured in opposite ends of the channel. Inserts 16 are provided with a hole 17 for receiving a fastening screw. Hole 17 formed in the insert is alignable with a hole 18 in the base 8' of the wall of the channel prior to assembly of the latch bolt assembly to facilitate fastening of the housing 8 to the background such as frame 5.

Referring again to FIG. 1, handle 7 may also be locked in its latched position, due to pivotal stump 12 being provided with a part 19 which is staggered with respect to the channel wall 15'' of the housing 8. A nonrotatable insert 20 is longitudinally slidable within the channel 34. Insert 20 is formed of at least one portion 21 which seats between the wall of the channel 34 and the staggered part 19 of the pivotal stump 12.

The pivotal stump 12 of handle 7 is provided with a space or gap 22 which is adapted to receive the insert 20 slidable longitudinally within the channel 34.

The wall 13 of the channel further is provided with a through slot or passage 23 opening toward the channel 34. The slot or passage 23 serves to seat projecting part 24 of a slide 25 mounted upon the exterior of housing 8. Slide 25 functions to operate the slidable insert 20 through slot 23 into channel 34.

Figure 3:
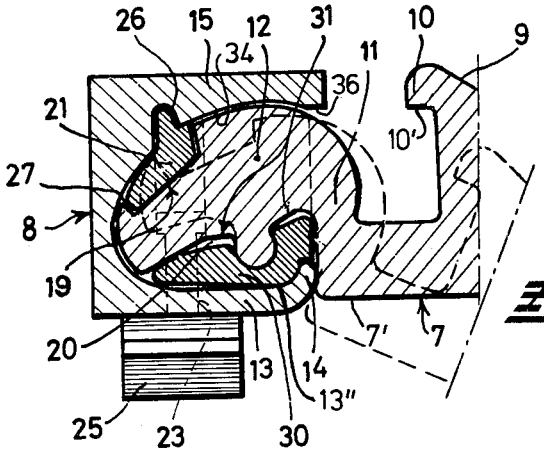
FIG. 3 is a cross section of said bolt.

Handle 7 is spring biased. The wall 15' of the channel 34 is provided with a longitudinal groove 26 disposed cross-sectionally with respect to the stump when same is seated in channel 34 and at a distance spaced from groove or step 27 formed along the free edge of the pivotal stump 12 of handle 7 into which groove 27 fits part of hairpin-shaped spring 32. A portion of hairpin shaped spring 32 is received within groove 26 adjoining the side of the groove or step 27 in the pivotal stump 12, with additional leg 29. Due to the action of said springs, the spring 32 causes the pivotal stump 12 to be partially pressed against the walls of the channel 34 within the housing 8 and permits the stump 12 to yield toward the position represented in broken lines in FIG. 3 when an internal pressure or force is exerted by manipulation of the handle. The latter is only possible when the slidable insert 20 with portion 21 is fully disposed within the gap 22 between the pair of stumps 12.

In a preferred embodiment of the present invention, the slidable insert 20 has two longitudinal extensions (nose-defining) or portions 21 and larger portion 30 defining a channel or groove which accommodates the pivotal stump 12 at the location of the staggered parts 19 and 31. In this position, slidable insert 20 is received in channel 34 between the stump 12 and wall 13' with portion 30 restrained by leg 13 of the housing 8. The handle 7 is locked when the slidable insert 20 is slid into a position whereby both noses 21 and 30 of insert 20 enclose a portion of the pivotal stump 12. When the insert 20 is moved slidably into a position wherein nose portions 21 and 30 are detached from the pivotal stump 12, handle 7 becomes yieldable.

Although the present invention has been shown and described in connection with a preferred embodiment thereof, it will be apparent to those skilled in the art that many variations and modifications may be made without departing from the invention in its broader aspects. It is therefore intended to have the appended claims cover all such variations and modifications as fall within the true spirit and scope of the invention.

What is claimed is:

1. A latch bolt assembly for accommodating latch means and comprising a housing capable of being surface to surface secured against a frame post and a handle pivotably seated in the housing, means interior of said housing for resiliently biasing said handle for movement between a normal latched condition and an unlatched condition, said handle having a neck portion, a free end portion and a pivot stump portion, said free end portion having an elongate recess defined therebetween, said housing having a base securable to the frame post and a pair of generally parallel flanges defining an elongate longitudinal channel capable of receiving said pivot stump portion for pivotal movement, said recess capable of receiving latch means therein and said free end having retainer means adapted to secure the latch means within the recess in the latched condition, insert cap means tightly seatable within said channel for closing off the opposite ends of said channel so as to prevent endwise removal of said pivot stump portion therefrom once same is installed within the channel and slidable insert means cooperable with said pivot stump portion to limit axial displacement thereof within said channel.

2. The latch bolt assembly as claimed in claim 1 wherein the housing is of oblong configuration.

3. The latch bolt assembly as claimed in claim 1 wherein the free end portion has a wedge-shaped cross-sectional configuration.

4. The latch bolt assembly as claimed in claim 1 and first further including second groove means, said first groove means defining an elongate longitudinal groove formed interior of said channel and said second groove means formed in said pivot stump, said resilient biasing means comprising spring means seated interior of said housing and within said second groove means.

5. The latch bolt assembly as claimed in claim 4 wherein said spring means comprise a spring of hairpin configuration seated within said second groove means and disposed between said pivot stump and one of said flanges.

6. The latch bolt as claimed in claim 5 in which there is an elongate through-slot formed in one leg portion of said housing and a slidable insert is disposed within said channel, said slidable insert comprising a slide assembly including projection, said projection is disposed to enter said elongate slot, said slidable insert also having a second projection receivable slidably within the second groove means in one end position of said slide assembly.

7. The latch bolt assembly as claimed in claim 6, wherein said channel includes a wall and said slidable insert includes a pair of projections, each extending into one of the first and second grooves respectfully of said channel and pivot stump, and to cooperate with the wall of said channel in one end position of said slidable insert, said projections being free from said pivot stump in the other end position of said insert.

8. The latch bolt assembly as claimed in claim 6 in which said pivot stump is formed of a pair of pivot stump members spaced apart forming a receiving gap and defining opposite stop portions, said slidable insert being seated within said gap for reciprocable sliding movement between said stop portions.

9. The latch bolt assembly as claimed in claim 8 in which said pivot stumps are staggered.

10. The latch bolt assembly as claimed in claim 6 wherein said slidable insert is nonrotatable.

* * * * *

UNITED STATES PATENT AND TRADEMARK OFFICE

CERTIFICATE OF CORRECTION

PATENT NO. : 4,461,500

DATED : July 24, 1984

INVENTOR(S) : Jasper van der Horst

It is certified that error appears in the above-identified patent and that said Letters Patent are hereby corrected as shown below:

Page 1, insert after "[22] Filed June 3, 1981"

-- [30] Foreign Application Priority Data

June 6, 1980 [NL] Netherlands 8003333 --

Signed and Sealed this

*Twenty-sixth* Day of *February 1985*

[SEAL]

*Attest:*

DONALD J. QUIGG

*Attesting Officer* *Acting Commissioner of Patents and Trademarks*